US005685789A

United States Patent [19]

Murphy

[11] Patent Number: 5,685,789

[45] Date of Patent: Nov. 11, 1997

[54] SPEED MEASURING SPORTS GOAL SYSTEM

[76] Inventor: Michael T. Murphy, 1 Vernon Rd., Medway, Mass. 02053

[21] Appl. No.: 744,941

[22] Filed: Nov. 6, 1996

[51] Int. Cl.[6] ..... A63B 63/02

[52] U.S. Cl. ..... 473/478; 273/371; 273/400

[58] Field of Search ..... 473/446, 478, 473/455, 456; 273/400, 371

[56] References Cited

U.S. PATENT DOCUMENTS

| | | | |
|---|---|---|---|
| D. 309,170 | 7/1990 | Bisch | D21/201 |
| 3,979,120 | 9/1976 | Dietrich | 473/478 |
| 4,245,843 | 1/1981 | Griggs | 273/393 |
| 4,276,548 | 6/1981 | Lutz | 343/7 PL |
| 4,858,922 | 8/1989 | Santavaci | 273/26 R |
| 5,419,565 | 5/1995 | Gordon et al. | 473/455 |
| 5,421,586 | 6/1995 | Amram et al. | 273/400 |
| 5,427,381 | 6/1995 | Macaluso et al. | 273/400 |
| 5,553,846 | 9/1996 | Frye et al. | 473/455 |
| 5,566,934 | 10/1996 | Black et al. | 473/455 X |
| 5,599,017 | 2/1997 | Bixler et al. | 473/455 X |

*Primary Examiner*—William H. Grieb

[57] ABSTRACT

A new Speed Measuring Sports Goal System for measuring the speed of a shot into a sports goal. The inventive device includes a pair of motion sensors positioned in-line and perpendicular to the entrance of a sports goal for sensing an object shot into the sports goal, a control unit connected to the motion sensors for calculating the speed of the object, and a display unit for providing a visible readout of the speed. The motion detection beams generated by the pair of motion sensors are parallel to one another and substantially perpendicular to the path of the object shot into the sports goal. The control unit detects when the object traverses the motion detection beams and calculates the speed of the object based on the time of travel between the motion detection beams.

5 Claims, 3 Drawing Sheets

FIG. 1
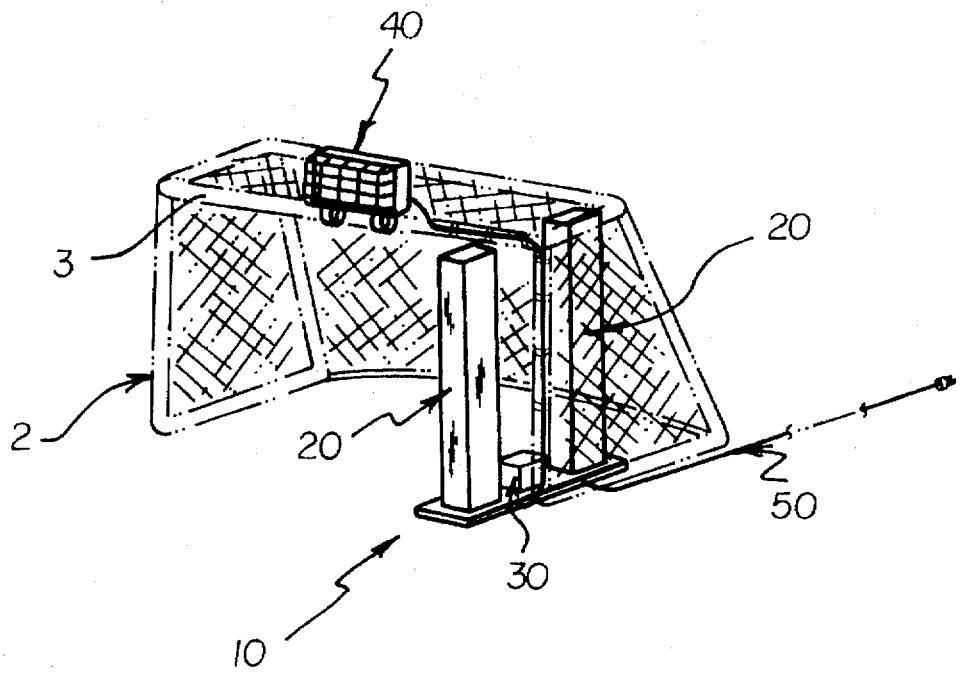
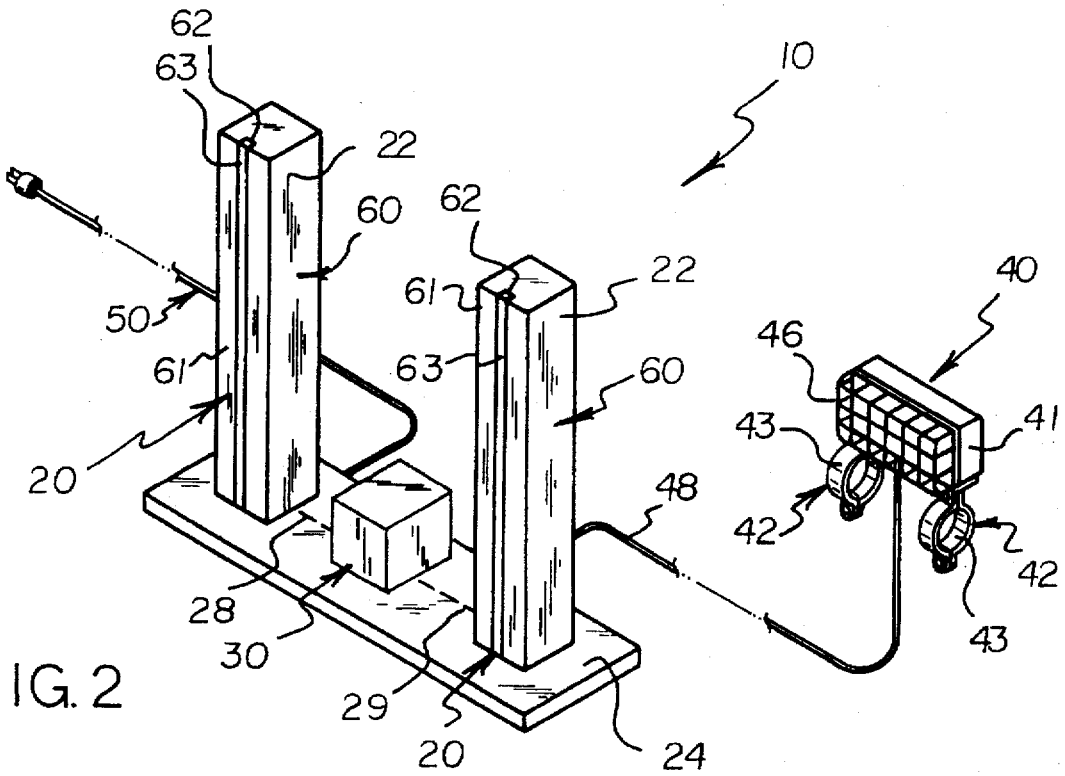
FIG. 2

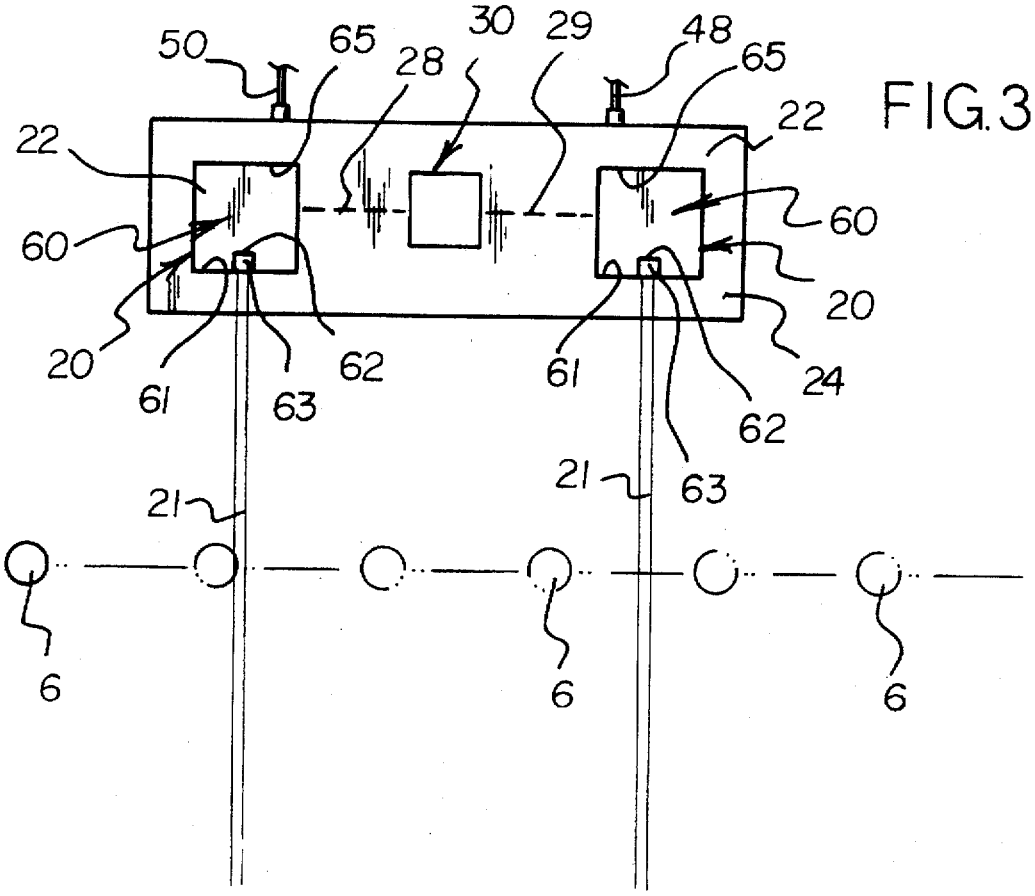
FIG. 3
FIG. 4
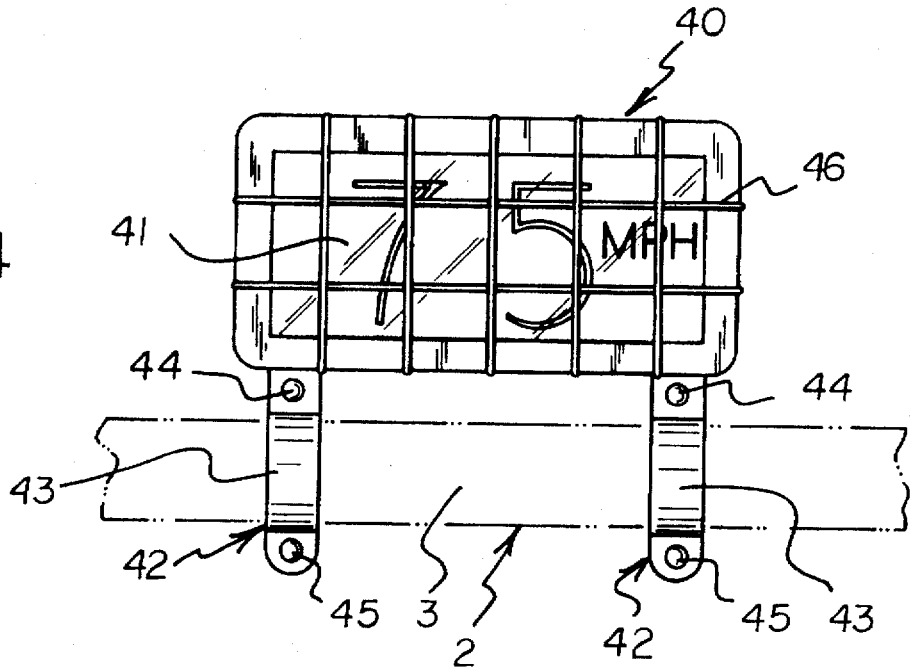

SPEED MEASURING SPORTS GOAL SYSTEM

BACKGROUND OF THE INVENTION

1. Field of the Invention

The present invention relates to sports goals and more particularly pertains to a new Speed Measuring Sports Goal System for measuring the speed of a shot into a sports goal.

2. Description of the Prior Art

The use of sports goals is known in the prior art. More specifically, sports goals heretofore devised and utilized are known to consist basically of familiar, expected and obvious structural configurations, notwithstanding the myriad of designs encompassed by the crowded prior art which have been developed for the fulfillment of countless objectives and requirements.

Known prior art sports goals include U.S. Pat. No. 4,858,922; U.S. Pat. No. 4,245,843; U.S. Pat. No. 5,421,586; U.S. Pat. No. 5,427,381; U.S. Pat. No. 3,979,120; U.S. Pat. No. 4,276,548 and U.S. Pat. No. D309,170.

While these devices fulfill their respective, particular objectives and requirements, the aforementioned patents do not disclose a new Speed Measuring Sports Goal System. The inventive device includes a pair of motion sensors positioned in-line and perpendicular to the entrance of a sports goal for sensing an object shot into the sports goal, a control unit connected to the motion sensors for calculating the speed of the object, and a display unit for providing a visible readout of the speed.

In these respects, the Speed Measuring Sports Goal System according to the present invention substantially departs from the conventional concepts and designs of the prior art, and in so doing provides an apparatus primarily developed for the purpose of measuring the speed of a shot into a sports goal.

SUMMARY OF THE INVENTION

In view of the foregoing disadvantages inherent in the known types of sports goals now present in the prior art, the present invention provides a new Speed Measuring Sports Goal System construction wherein the same can be utilized for measuring the speed of a shot into a sports goal.

The general purpose of the present invention, which will be described subsequently in greater detail, is to provide a new Speed Measuring Sports Goal System apparatus and method which has many of the advantages of the sports goals mentioned heretofore and many novel features that result in a new Speed Measuring Sports Goal System which is not anticipated, rendered obvious, suggested, or even implied by any of the prior art sports goals, either alone or in any combination thereof.

To attain this, the present invention generally comprises a pair of motion sensors positioned in-line and perpendicular to the entrance of a sports goal for sensing an object shot into the sports goal, a control unit connected to the motion sensors for calculating the speed of the object, and a display unit for providing a visible readout of the speed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Speed Measuring Sports Goal System apparatus and method which has many of the advantages of the sports goals mentioned heretofore and many novel features that result in a new Speed Measuring Sports Goal System which is not anticipated, rendered obvious, suggested, or even implied by any of the prior art sports goals, either alone or in any combination thereof.

It is another object of the present invention to provide a new Speed Measuring Sports Goal System which may be easily and efficiently manufactured and marketed.

It is a further object of the present invention to provide a new Speed Measuring Sports Goal System which is of a durable and reliable construction.

An even further object of the present invention is to provide a new Speed Measuring Sports Goal System which is susceptible of a low cost of manufacture with regard to both materials and labor, and which accordingly is then susceptible of low prices of sale to the consuming public, thereby making such Speed Measuring Sports Goal System economically available to the buying public.

Still yet another object of the present invention is to provide a new Speed Measuring Sports Goal System which provides in the apparatuses and methods of the prior art some of the advantages thereof, while simultaneously overcoming some of the disadvantages normally associated therewith.

Still another object of the present invention is to provide a new Speed Measuring Sports Goal System for measuring the speed of a shot into a sports goal.

Yet another object of the present invention is to provide a new Speed Measuring Sports Goal System which includes a pair of motion sensors positioned in-line and perpendicular to the entrance of a sports goal for sensing an object shot into the sports goal, a control unit connected to the motion sensors for calculating the speed of the object, and a display unit for providing a visible readout of the speed.

Still yet another object of the present invention is to provide a new Speed Measuring Sports Goal System that provides a player with a readout of the speed of his or her shot.

Even still another object of the present invention is to provide a new Speed Measuring Sports Goal System that can be used by a hockey player to practice and improve his or her shooting skills.

Even still another object of the present invention is to provide a new Speed Measuring Sports Goal System that, if desired, can be easily installed on and removed from a sports goal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a new Speed Measuring Sports Goal System installed in a sports goal according to the present invention.

FIG. 2 is an illustration of the present invention.

FIG. 3 is a top view of the present invention.

FIG. 4 is a front view of the display unit of the present invention.

DESCRIPTION OF THE PREFERRED EMBODIMENT

Figure 5:
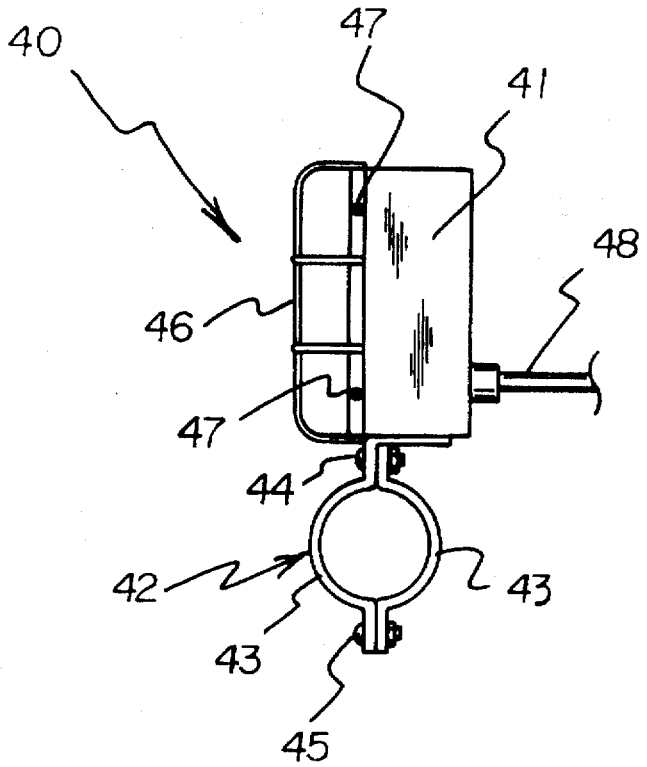
FIG. 5 is a side view of the display unit of the present invention.

With reference now to the drawings, and in particular to FIGS. 1 through 6 thereof, a new Speed Measuring Sports Goal System embodying the principles and concepts of the present invention and generally designated by the reference numeral 10 will be described.

More specifically, it will be noted that the Speed Measuring Sports Goal System 10 comprises a pair of motion sensors 20 positioned in-line and perpendicular to the entrance of a sports goal 2 for sensing an object 6 shot into the sports goal 2, a control unit 30 connected to the motion sensors 20 for calculating the speed of the object 6, and a display unit 40 for providing a visible readout of the speed.

As best illustrated in FIGS. 1 through 3, it can be shown that the pair of motion sensors 20 are mounted in a pair of tower assemblies 22 which are mounted in-line on a lower base 24 such that the motion detection beams 21 generated by the pair of motion sensors 20 are parallel to one another. The pair of motion sensors 20 are mounted on the tower base 24 at a predetermined distance from each another. The tower base 24 is positioned in the entrance of the sports goal 2 such that the motion detection beams 21 generated by the pair of motion sensors 20 are substantially perpendicular to the path of the object 6 shot into the sports goal 2. The control unit 30 detects when the object 6 traverses the motion detection beams 21 and calculates the speed of the object 6 based on the time of travel between the motion detection beams 21. Signal leads 28 and 29 connect the pair of motion sensors 20 to the control unit 30. A power source 50 is provided for powering the system 10.

Figure 6:
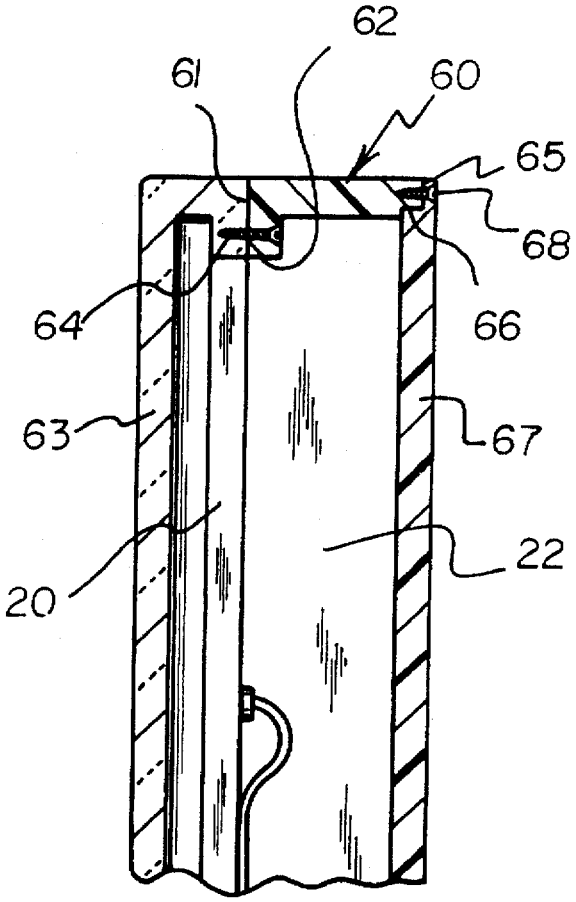
FIG. 6 is a cross sectional view of the tower assembly taken along line 6—6 of FIG. 3.

As best illustrated in FIG. 6, it can be shown that each of the pair of tower assemblies 22 comprises a tower shell 60 having a front wall 61 and a rear wall 65. A longitudinal opening 62 is provided in the front wall 61 of the tower shell 60 and one of the pair of motion sensors 20 is mounted in the tower shell 60 within the longitudinal opening 62. A protective insert 63 is mounted in the longitudinal opening 62 in front of the motion sensor 20 for protecting the motion sensor 20. The protective insert 63 is made of a transparent material such as Plexiglass. An access opening 66 and an access panel 67, mounted within the access opening 66, are provided in the rear wall 65 of the tower shell 60. Fasteners 64 and 68 are used to mount the protective insert 63 in the longitudinal opening 62 and the access panel 67 in the access opening 66, respectively.

As best illustrated in FIGS. 4 and 5, it can be shown that the display unit 40 comprises a digital readout device 41 and a mounting bracket 42 attached to the digital readout device 41 for mounting the digital readout device 41 on a frame member 3 of the sports goal 2. The mounting bracket 42 comprises a pair of C-shaped clamping members 43 adapted to embrace the frame member 3. One of the pair of C-shaped clamping members 43 is attached to the digital readout device 41 and the pair of C-shaped clamping members 43 are clamped together around the frame member 3 of the sports goal 2 with fasteners 44 and 45. An open mesh steel cage 46 is mounted in front of the digital readout device 41 for protecting the digital readout device 41. The open mesh steel cage 46 is attached to the digital readout device 41 with a fastener 47 and may be easily removed for maintenance. A signal lead 48 connects the digital readout device 41 to the control unit 30.

In use, the pair of motion sensors 20 are positioned in the entrance of the sports goal 2 such that the motion detection beams 21 generated by the pair of motion sensors 20 are substantially perpendicular to the path of the object 6 shot into the sports goal 2. When an object 6, such as a hockey puck, is shot into the sports goal 2, the control unit 30 detects when the object 6 traverses the motion detection beams 21. The control unit 30 calculates the speed of the object 6 based on the time of travel between the motion detection beams 21 and transmits the speed to the display unit 40 mounted on a frame member 3 of the sports goal 2. The digital readout device 41 provides a visible readout of the speed of the object 6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Speed Measuring Sports Goal System for measuring the speed of an object projected into a sports goal, comprising:

a pair of motion sensors positioned in-line and perpendicular to an entrance of said sports goal for sensing said object projected into said sports goal, said pair of motion sensors positioned at a predetermined distance from each another and generating parallel motion detection beams;

a control unit connected to said pair of motion sensors for calculating the speed of said object, said control unit detecting when said object traverses said pair of motion sensors and calculating the speed of said object based on the time of travel between said pair of motion sensors;

a display unit connected to said control unit for providing a visible readout of the speed; and a power source for powering said system.

2. The Speed Measuring Sports Goal System of claim 1, further comprising:

a pair of tower assemblies, said pair of motion sensors mounted in said pair of tower assemblies, and a tower base, said pair of tower assemblies mounted in-line on said tower base.

3. The Speed Measuring Sports Goal System of claim 2, wherein each of said pair of tower assemblies comprises:

a tower shell having a front wall, said front wall of said tower shell having a longitudinal opening therein, one of said pair of motion sensors mounted in said tower shell within said longitudinal opening, and a protective insert mounted in said longitudinal opening in front of said motion sensor for protecting said motion sensor, said protective insert being made of a transparent material.

4. The Speed Measuring Sports Goal System of claim 1, wherein said display unit comprises:

a digital readout device, a mounting bracket attached to said digital readout device for mounting said digital readout device on a frame member of said sports goal, and an open mesh steel cage mounted in front of said digital readout device for protecting said digital readout device.

5. The Speed Measuring Sports Goal System of claim 4, wherein said mounting bracket comprises a pair of C-shaped clamping members adapted to embrace said frame member, one of said pair of C-shaped clamping members attached to said digital readout device, said pair of C-shaped clamping members clamped together around said frame member of said sports goal.

* * * * *